US008215952B2

(12) United States Patent
Min

(10) Patent No.: US 8,215,952 B2
(45) Date of Patent: Jul. 10, 2012

(54) BURNER HAVING VARIABLE OUTPUT STRUCTURE

(75) Inventor: Tae Sik Min, Seoul (KR)

(73) Assignee: Kyungdong Navien Co., Ltd., Gyeonggi-Do (KR)

( * ) Notice: Subject to any disclaimer, the term of this patent is extended or adjusted under 35 U.S.C. 154(b) by 71 days.

(21) Appl. No.: 12/664,820

(22) PCT Filed: Mar. 14, 2008

(86) PCT No.: PCT/KR2008/001437
§ 371 (c)(1),
(2), (4) Date: Dec. 15, 2009

(87) PCT Pub. No.: WO2008/153265
PCT Pub. Date: Dec. 18, 2008

(65) Prior Publication Data

US 2010/0178626 A1 Jul. 15, 2010

(30) Foreign Application Priority Data

Jun. 15, 2007 (KR) ..... 10-2007-0058927

(51) Int. Cl.
*F23D 14/62* (2006.01)

(52) U.S. Cl. ..... 431/354; 431/12; 431/8

(58) Field of Classification Search ..... 431/354, 431/12, 8
See application file for complete search history.

(56) References Cited

U.S. PATENT DOCUMENTS

2007/0054228 A1* 3/2007 Fogliani et al. ..... 431/354

FOREIGN PATENT DOCUMENTS

| | | | |
|---|---|---|---|
| JP | S56-158720 | | 4/1955 |
| JP | 61-265409 | | 11/1986 |
| JP | 5-302705 | A | 11/1993 |
| JP | 9-280514 | A | 10/1997 |
| JP | 2001-124331 | A | 5/2001 |
| KR | 20-0173642 | Y1 | 12/1999 |

OTHER PUBLICATIONS

English language abstract of JP 61-265409.
International Search Report mailed May 14, 2008 for International Application PCT/KR2008/001437.
JP 2001124331 Abstract.

* cited by examiner

*Primary Examiner* — Alfred Basichas
(74) *Attorney, Agent, or Firm* — Hershkovita & Associates, LLC; Abraham Herskovitz

(57) ABSTRACT

A burner having a variable output structure includes a flame-hole plate having a plurality of flame holes located on a surface of the flame-hole plate. The plurality of flame holes are exposed to a combustion chamber. Further, the burner can include a flame hole adjusting unit configured to change an output of the burner by adjusting a size of each of the plurality of flame holes according to a load required in a combustion device.

5 Claims, 1 Drawing Sheet

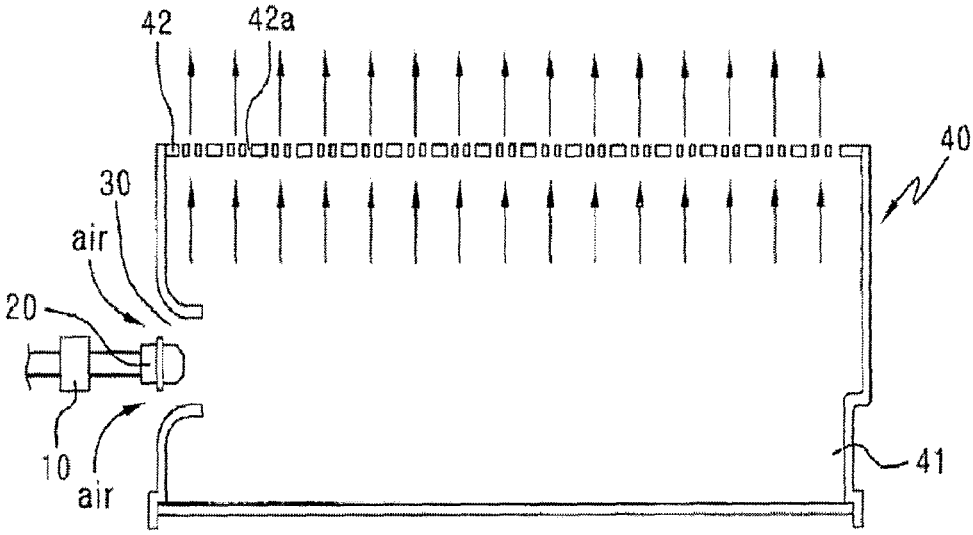
FIG. 1 - PRIOR ART
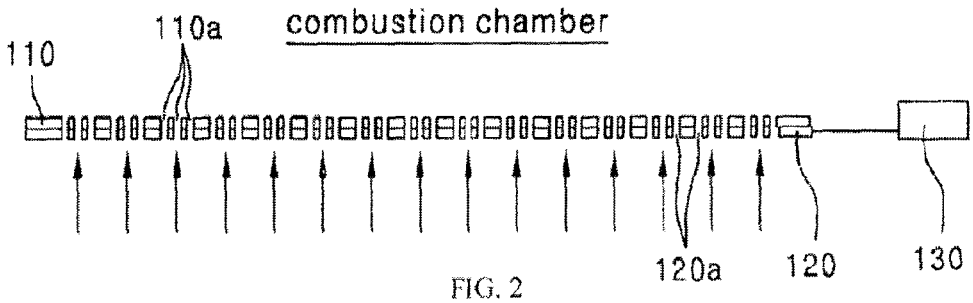
FIG. 2
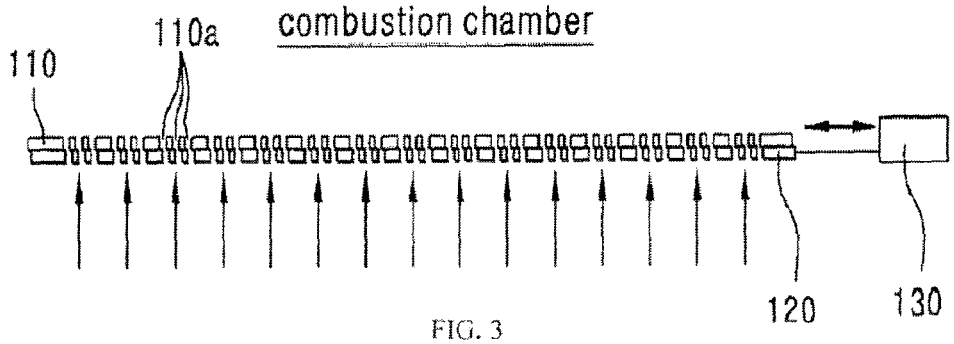
FIG. 3

BURNER HAVING VARIABLE OUTPUT STRUCTURE

RELATED APPLICATIONS

This is an US National Phase Patent Application Under 35 USC §371 of International Patent Application No. PCT/KR2008/001437, filed on Mar. 14, 2008, which claims priority of Korean Patent Application No. 10-2007-0058927, filed on Jun. 15, 2007.

BACKGROUND OF THE INVENTION

1. Field of the Invention

The present invention relates to a burner having variable output structure, and more particularly, to a burner having variable output structure that can adjust an output of a burner by adjusting a position of a flame-hole plate.

2. Discussion of Background Information

In general, according to a method of burning gas fuel in a gas boiler having a premixed burner, gas and air are mixed in advance with each other at a mixture ratio corresponding to optimum combustion, and then supplied to a flame-hole surface to burn.

FIG. 1 is a schematic view showing a structure of a general burner in the related art.

The general burner includes a gas valve 10 that adjusts a pressure of gas supplied to the general burner, a nozzle 20 that injects the gas supplied through the gas valve 10, a mixture inlet 30 through which the gas injected from the nozzle 20 is mixed and supplied, an inner space 41 of the general burner 40 to which a mixture supplied through the mixture inlet 30 is supplied, and a flame-hole plate 42 that includes a plurality of flame holes 42*a* in order to inject the mixture supplied to the inner space 41 to a combustion chamber (not shown).

When a load required in a combustion device is large, the gas valve 10 is controlled so that the gas is supplied to the general burner at a high pressure for the purpose of a high output of the general burner. In contrast, when the load required in the combustion device is small, the gas valve is controlled so that the gas is supplied to the general burner at a low pressure for the purpose of a low output of the general burner.

In this case, a speed of the mixture, which is injected into the combustion chamber through the flame holes 42*a*, depends on the gas pressure that is determined by the control of the gas valve 10. That is, if the gas pressure is high, the speed of the mixture injected through the flame holes 42*a* will be high.

However, according to the general burner having the above-mentioned structure, when the load required in the combustion device is small, if the gas is supplied at low pressure, flames are generated on an inner surface of the flame-hole plate 42 facing an inside of the combustion chamber. As a result, there is a problem in that combustion is abnormally performed.

That is, if the speed of the mixture injected through the flame holes 42*a* is a predetermined speed or less, a backfire, where flames are generated in the flame holes 42*a*, occurs.

The present invention has been made to solve the above-mentioned problem, and an object of the present invention is to provide a burner having variable output structure that maintains the speed of the mixture injected through the flame holes at a predetermined speed or more by supplying gas through a gas valve at a predetermined pressure or more, and prevents an occurrence of backfire at a lowoutput by adjusting an opened area of the flame holes.

SUMMARY OF THE INVENTION

In order to achieve the above-mentioned object, according to an aspect of the present invention, a burner having a variable output structure includes a flame-hole plate that includes a plurality of flame holes formed on a surface thereof exposed to a combustion chamber, and a flame hole adjusting unit that changes an output of the burner, by adjusting the size of each flame hole according to load required in the combustion device.

In one embodiment of the invention, the flame-hole plate may be formed of a stationary flame-hole plate that includes stationary flame holes and is fixed. The flame hole adjusting unit may be formed of a movable flame-hole plate that is disposed to come in contact with the stationary flame-hole plate, includes a plurality of variable flame holes at positions corresponding to the stationary flame holes of the stationary flame-hole plate, and is movable to adjust an amount of a mixture injected through the stationary flame holes.

According to another embodiment of the invention, the burner having a variable output structure may further include a driving unit for changing a position of the movable flame-hole plate while the movable flame-hole plate comes in contact with the stationary flame-hole plate.

As described in detail above, the burner having a variable output structure according to the present invention can obtain an advantage of stably performing combustion without a backfire, even at a low output, by adjusting the size of the flame hole that is formed in the flame-hole plate.

BRIEF DESCRIPTION OF THE DRAWINGS

FIG. 1 is a schematic view showing a structure of a general burner in the related art.

FIG. 2 is a schematic cross-sectional view of a flame-hole plate of a burner according to an embodiment of the present invention.

FIG. 3 is a schematic cross-sectional view showing that a movable flame-hole plate is moved by a driving unit in the structure shown in FIG. 2.

DETAILED DESCRIPTION OF EMBODIMENTS

The structure and operation of a preferred embodiment of the present invention will be described in detail below with reference to accompanying drawings.

The present invention relates to a burner that can freely adjust an output thereof by adjusting the size of a flame hole through which a mixture is injected into a combustion chamber (not shown) while the pressure of gas in the burner is maintained constant.

Referring to FIG. 2, like in the related art, there is provided a stationary flame-hole plate 110 that includes a plurality of stationary flame holes 110*a* formed on a surface thereof exposed to a combustion chamber. The stationary flame-hole plate 110 is not movable, unlike a movable flame-hole plate 120 to be described below, and has the same shape and structure as the flame-hole plate 42 shown in FIG. 1.

It is possible to adjust an amount of the mixture, which is injected through the plurality of stationary flame holes 110*a*, by adjusting the size of each stationary flame hole. That is, if the size of each of the plurality of stationary flame holes 110*a* through which the mixture is injected is adjusted while the pressure of gas supplied through the gas valve 10 shown in FIG. 1 is maintained constant, gas can be supplied so that combustion is stably performed at a low output of the mixture without a reduction in the pressure of gas to be supplied.

For this purpose, a flame hole adjusting unit, which adjusts the size of each of the plurality of stationary flame holes 110*a*, can be provided.

The flame hole adjusting unit can include, for example, a movable flame-hole plate 120 including variable flame holes 120*a*, and a driving unit 130 that changes a position of the movable flame-hole plate 120.

The movable flame-hole plate 120 is disposed to come in contact with one surface of the stationary flame-hole plate 110, and includes the variable flame holes 120*a* at positions corresponding to the plurality of stationary flame holes 110*a* of the stationary flame-hole plate 110, so that the number of the variable flame holes 120*a* is equal to that of the plurality of stationary flame holes 110*a*.

In this case, when the position of the movable flame-hole plate 120 is changed, the positions of the variable flame holes 120*a* corresponding to the stationary flame holes 110*a* are changed, so that an open area of the stationary flame holes 110*a* is changed. Therefore, the amount of the mixture, which is injected through the plurality of stationary flame holes 110*a*, is adjusted.

The driving unit 130 can be, for example, a stepping motor that is coupled with the movable flame-hole plate 120. Accordingly, if the revolutions per minute (RPM) of the stepping motor is controlled according to a load required in the combustion device, a movement distance of the movable flame-hole plate 120 is controllably adjusted. As a result, the open area of the plurality of stationary flame holes 110*a* is changed, so that an output of the burner is adjusted.

That is, when a high output is required, the position of the movable flame-hole plate 120 is controlled so that the plurality of stationary flame holes 110*a* are opened as shown in FIG. 2. When a low output is required, the position of the movable flame-hole plate 120 is controlled to move a distance so that the plurality of stationary flame holes 110*a* are adjusted as shown in FIG. 3.

According to this structure, even if a low output is required in the combustion device, the mixture injected through the plurality of stationary flame hole 110*a* can be maintained at a predetermined speed or more because the pressure of gas is maintained at a predetermined pressure or more. Therefore, it is possible to prevent an occurrence of a backfire, where flames are generated at an inside of the plurality of stationary flame holes 110*a*.

The movable flame-hole plate 120 can be controlled by the driving unit 130 in the embodiment shown in FIGS. 2 and 3. However, it will be apparent to those skilled in the art that the movable flame-hole plate 120 can be manually moved without the driving unit 130.

Although the present invention has been described in connection with the exemplary embodiments of the present invention, it will be apparent to those skilled in the art that various modifications and changes may be made thereto without departing from the scope and spirit of the invention.

The invention claimed is:

1. A burner having a variable output structure for a gas boiler, the burner comprising:

a stationary plane flame-hole plate that includes a plurality of stationary flame holes located on a surface of the flame-hole plate, the surface being exposed to a combustion chamber, and the stationary flame holes being uniformly spaced all over the surface; and a movable plane flame-hole plate that is configured to be movable against the stationary plane flame-hole plate while keeping contacting with the stationary plane flame-hole plate and a plurality of variable flame holes located at positions corresponding to the stationary flame holes of the stationary plane flame-hole plate, the variable flame holes being uniformly spaced all over a surface of the movable plane flame-hole plate and being respectively disposed at a respective position corresponding to a respective position of the respective stationary flame hole of the stationary plane flame-hole plate, wherein said variable flame holes are formed of the same shape as said stationary flame holes, wherein a number of the variable flame holes are same as a number of the stationary flame holes, wherein the stationary plane flame-hole plate and the movable plane flame hole plate are formed between a gas-air mixing chamber and the combustion chamber all along therebetween, and wherein the movable plane flame-hole plate is movable to equally adjust an amount of each open area of all the flame holes of the stationary plane flame-hole plate and then to adjust an output of the burner according to a required load, while maintaining the pressure of gas supplied to the burner at a predetermined value or above.

2. The burner according to claim 1 further comprising a driving unit configured to change a position of the movable plane flame-hole plate while the movable plane flame-hole plate comes in contact with the stationary plane flame-hole plate.

3. The burner according to claim 2, wherein the driving unit is controlled according to the load required in the combustion device.

4. The burner according to claim 1, wherein the burner is configured to maintain a gas pressure at a first predetermined level or more by maintaining an injection speed of the mixture at a second predetermined level or more in case that a low output is required.

5. A burner having a variable output structure for a gas boiler, the burner comprising:

a stationary plane flame-hole plate that includes a plurality of stationary flame holes located on a surface of the flame-hole plate, the surface being exposed to a combustion chamber, and the stationary flame holes being uniformly spaced all over the surface;

a movable plane flame-hole plate that is configured to be movable against the stationary plane flame-hole plate while keeping contacting with the stationary plane flame-hole plate and a plurality of variable flame holes located at positions corresponding to the stationary flame holes of the stationary plane flame-hole plate, the variable flame holes being uniformly spaced all over a surface of the movable plane flame-hole plate and being respectively disposed at a respective position corresponding to a respective position of the respective stationary flame hole of the stationary plane flame-hole plate; and a driving unit configured to change a position of the movable plane flame-hole plate while the movable flame-hole plate comes in contact with the stationary plane flame-hole plate, wherein said variable flame holes are formed of the same shape as said stationary flame holes, wherein a number of the variable flame holes are same as a number of the stationary flame holes, wherein the stationary plane flame-hole plate and the movable plane flame hole plate are formed between a gas-air mixing chamber and the combustion chamber all along therebetween, wherein the movable plane flame-hole plate is movable to equally adjust an amount of each open area of all the flame holes of the stationary plane flame-hole plate and then to adjust an output of the burner according to a required load, while maintaining the pressure of gas supplied to the burner at a predetermined value or above, wherein the burner is configured to maintain a gas pressure at a first predetermined level or more by maintaining an injection speed of the mixture at a second predetermined level or more in case that a low output is required, and wherein the burner is controlled according to the load required in the combustion device.

* * * * *